US006283136B1

(12) United States Patent
Chen

(10) Patent No.: US 6,283,136 B1
(45) Date of Patent: Sep. 4, 2001

(54) COLLAPSIBLE TENT

(76) Inventor: Fengchun Chen, Room 303, No. 5, Lane 59, Huazhong Street Minglounanqu, Jiangdong District, Ningbo City Zhejiang 315040 (CN)

( * ) Notice: Subject to any disclaimer, the term of this patent is extended or adjusted under 35 U.S.C. 154(b) by 0 days.

(21) Appl. No.: 09/311,661

(22) Filed: May 13, 1999

(30) Foreign Application Priority Data

May 16, 1998 (CN) ..... 98214317

(51) Int. Cl.[7] ..... E04H 15/46; E04H 15/52

(52) U.S. Cl. ..... 135/144; 135/147; 135/159; 135/160; 135/130

(58) Field of Search ..... 135/122, 128, 135/130, 143, 144, 146, 147, 157–160; 52/641, 643, 646

(56) References Cited

U.S. PATENT DOCUMENTS 1,846,011 * 2/1932 Adams .
2,130,919 * 9/1938 Erickson et al. .
2,135,961 * 11/1938 Chenworth .
2,723,673 * 11/1955 Call .
2,771,896 * 11/1956 Call .
3,085,586 * 4/1963 McDonough .
4,641,676 * 2/1987 Lynch .
5,035,253 * 7/1991 Bortles .
6,173,726 * 1/2001 Talmadge ..... 135/144

FOREIGN PATENT DOCUMENTS

218685 * 12/1961 (AT) ..... 135/180

* cited by examiner

*Primary Examiner*—Robert Canfield
(74) *Attorney, Agent, or Firm*—Seed Intellectual Property Law Group PLLC

(57) ABSTRACT

A collapsible tent comprises top connecting means at the top of the tent; a plurality of upright legs; a slider slideably received on each upright leg; upper roof support bars pivotally connected to the top connecting means; lower roof support bars which each are connected at one end to its respective upper roof support bar and at the other end to a top of its respective upright leg; stay bars which each are connected at one end to its respective lower roof support bar and at the other end to the slider; a parallel bar assembly interconnecting adjacent ones of the upright legs, stay bars for supporting the lower support bars, each stay pivotally connected at one end to the upper part of its respective lower roof support bar and at the other end to the slider; stay bars for supporting the parallel bar assembly, each stay bar pivotally connected at one end to its respective parallel bar assembly and at the other end to the slider ; and stop means for maintaining the slider in position to maintain the tent in an erected position. The tent according to the present invention can be produced as serialization products for various situation applications.

19 Claims, 4 Drawing Sheets

COLLAPSIBLE TENT

FIELD OF THE INVENTION

The present invention relates to collapsible tents, which can be used as outdoor products in parks, courtyards, sea beaches, field living, vendor's mobile stands, army camping, nomadism, geologic surveys, etc.

BACKGROUND OF THE INVENTION

Most of the tents, which are used in field living, army camping, parks, courtyards, vendor's mobile stands, etc., are assembled on site with separate parts, which makes the use thereof trouble, the operation thereof time-consuming and laboursome, and the carry thereof inconvenient. Although some foldable tents have been commercially available recently, none of them can meet the various requirements of different application situations.

U.S. Pat. No. 4,607,656 discloses a quick-erect collapsible shelter having four or more telescoping legs, connected by a framework which includes pluralities of X-shaped linkages and a slider on each leg to provide interconnecting truss between the legs and support for a covering canopy. The known shelter can not withstand the rigors of weather and other environmental effects, and are so complex that the design thereof is not reasonable.

SUMMARY OF THE INVENTION

An object of the present invention is to provide a collapsible tent which has a simple, compact and firm structure with few structural members, can be operated when being expanded or collapsed, and can be carried conveniently in a collapsed state.

Another object of the present invention is to provide a collapsible tent, which can be expanded or collapsed interlockingly by separating or closing legs thereof with all other movable members of the tent moving synchronously to expand or collapse the tent.

The collapsible tent according to the present invention comprises top connecting means at the top of the tent; a plurality of upright legs; a slider slideably received on each upright leg; upper roof support bars which are pivotally connected at the upper ends thereof to the top connecting means; lower roof support bars which each are connected at one end to its respective upper roof support bar and at the other end to a top of its respective upright leg; stay bars which each are connected at one end to its respective lower roof support-bar and at the other end to the slider; a parallel bar assembly interconnecting adjacent ones of the upright legs, each parallel bar assembly having a T shaped connecting member, upper parallel bars each of which is pivotally connected at one end to the vertical leg of the T shaped connecting member and at the other end to the upper end of its respective leg, and lower parallel bars each of which is pivotally connected at one end to its respective flange of the T shaped connecting member and at the other end to the upper end of its respective leg; stay bars for supporting the lower support bar, each stay pivotally connected at one end to the upper part of its respective lower roof support bar and at the other end to the slider; stay bars for supporting the parallel bar assembly, each stay bar pivotally connected at one end to its respective lower parallel bar and at the other end to the slider; and stop means for maintaining the slider in position to maintain the tent in an erected position.

BRIEF DESCRIPTION OF THE DRAWINGS

The present invention will become apparent from the following detailed description of some preferred embodiments when taken together with the accompanying drawings, in which.

DETAILED DESCRIPTION OF THE INVENTION

In the figures, arrows represent the moving directions of respective members.

Figure 1:
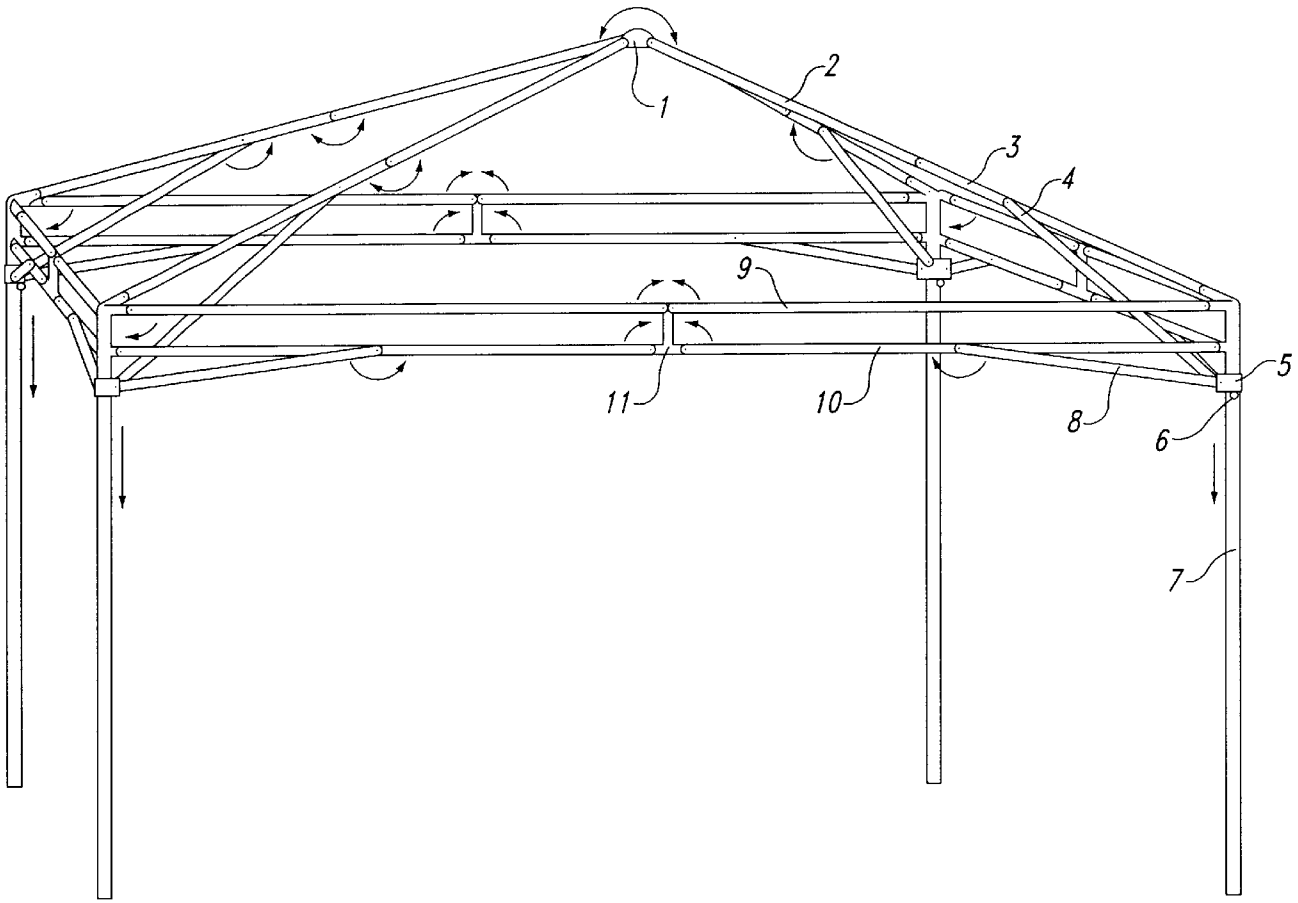
FIG. 1 is a perspective view of a collapsible tent according to a first embodiment having four upright legs and a broach roof.

As shown in FIG. 1, a collapsible tent according to a first embodiment of the invention has four upright legs 7 and a broach roof. The broach roof comprises a top connecting member 1 at the apex thereof, four upper roof support bars 2 each of which has an upper end pivotally connected to top connecting member 1, and four lower roof support bars 3 each of which is pivotally connected at one end to the lower end of upper roof support bar 2 and at the other end to a top of leg 7. Each leg 7 has a slider 5 which is slideably received thereon. A stay bar 4 is pivotally connected at one end to the upper part of lower roof support bar 3 and at the other end to slider 5. Adjacent ones of legs 7 are interconnected by a parallel bar assembly. Each parallel bar assembly is formed by a T shaped connecting member 11, two upper parallel bars 9 each of which is pivotally connected at one end to the vertical leg of T shaped connecting member 11 and at the other end to the upper end of a respective leg 7, and two lower parallel bars 10 each of which is pivotally connected at one end to its respective flange of T shaped connecting member 11 and at the other end to the upper end of a respective leg 7. Parallel bars 9, 10 are parallel to each other. A stay bar 8 is pivotally connected at one end to a respective lower parallel bar 10 and at the other end to slider 5. A stop means 6 is provided on leg 7 to stop slider 5 when the tent is in a expanded state.

Figure 2:
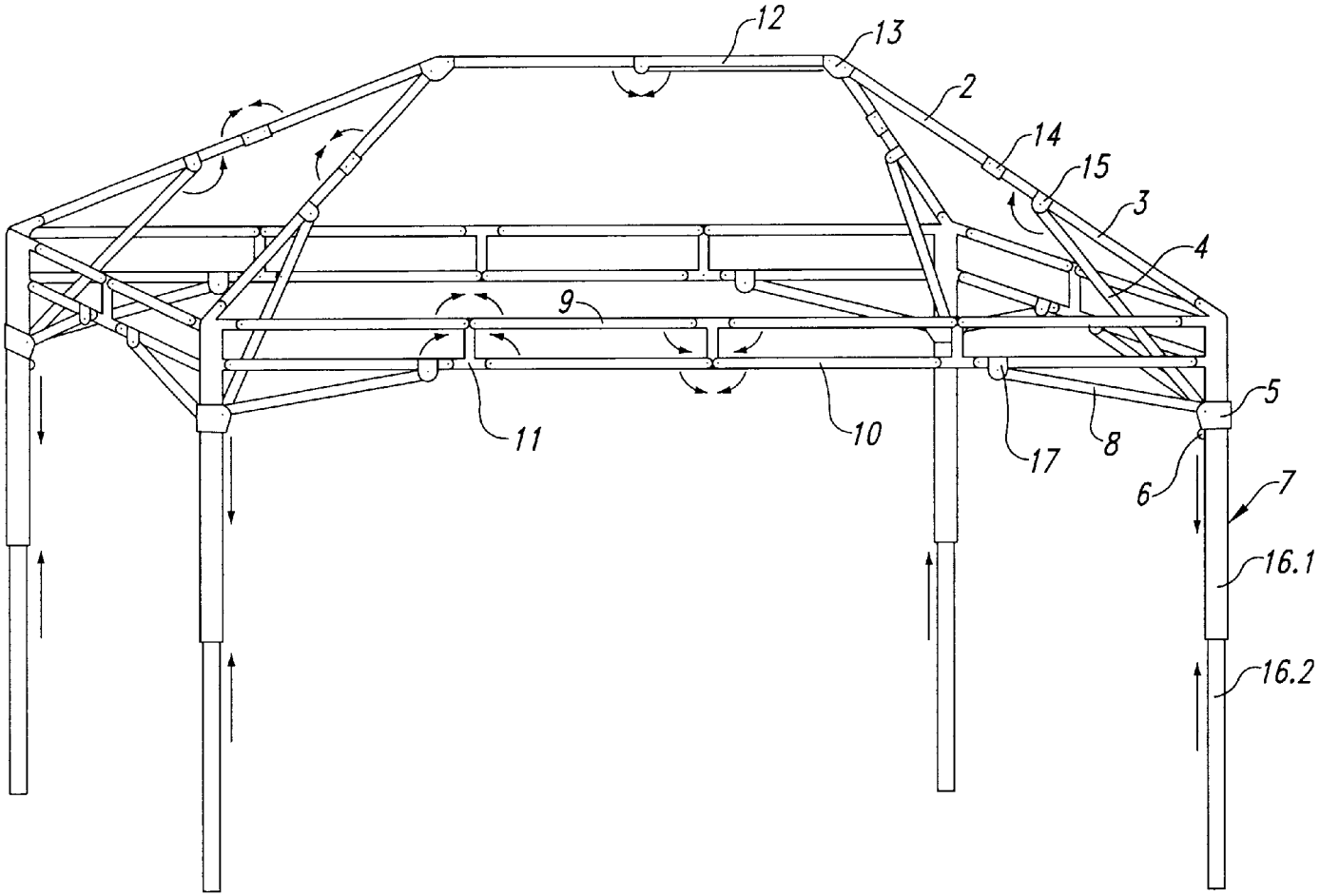
FIG. 2 is a perspective view of a collapsible tent according to a second embodiment having four upright legs and a hipped roof.

According to a second embodiment as shown in FIG. 2, a collapsible tent in the form of a rectangle has four upright legs 7 and a hipped roof. The hipped roof comprises a top connecting means having two top connecting members 13 each of which is pivotally connected to the ends of its respective two upper bars 2, and two bars 12 which are pivotally connected to each other and each of which is pivotally connected to a respective top connecting member 13. Upper roof support bar 2 is pivotally connected to one end of lower roof support bar 3 by means of a joint 14. The other end of lower roof support bar 3 is pivotally connected to the top of leg 7. On each short side of the tent, two legs 7 are interconnected by a parallel bar assembly as shown in FIG. 1. However, on each long side of the tent, two legs 7 are interconnected by a conjoined parallel bar assembly formed by two parallel bar assemblies as shown in FIG. 1 connected to each other via T shaped connecting member 11, as shown in FIG. 2. The conjoined parallel bar assembly may be used in the first embodiment and other embodiments as described below thereby reducing the overall length of a large tent in a collapsed state to facilitate the carry thereof. Similarly, a conjoined parallel bar assembly may be formed by two or more pairs of the parallel bar assembly shown in FIG. 1. The legs of the tent may be telescopic. As shown in FIG. 2, each leg 7 includes an upper leg section 16.1 and a lower leg section 16.2 telescopically received in upper leg section 16.1. Each leg 7 may have three or more leg sections. Telescoping leg 7 has means for retaining axially slidable sections at various positions.

As shown in FIG. 2, stay bar 8 is pivotally connected at one end to its respective lower parallel bar 10 by means of a joint 17 and at the other end to slider 5. Stay bar 4 is pivotally connected at one end to the upper part of lower roof support bar 3 by means of a joint 15 and at the other end to slider 5.

Figure 3:
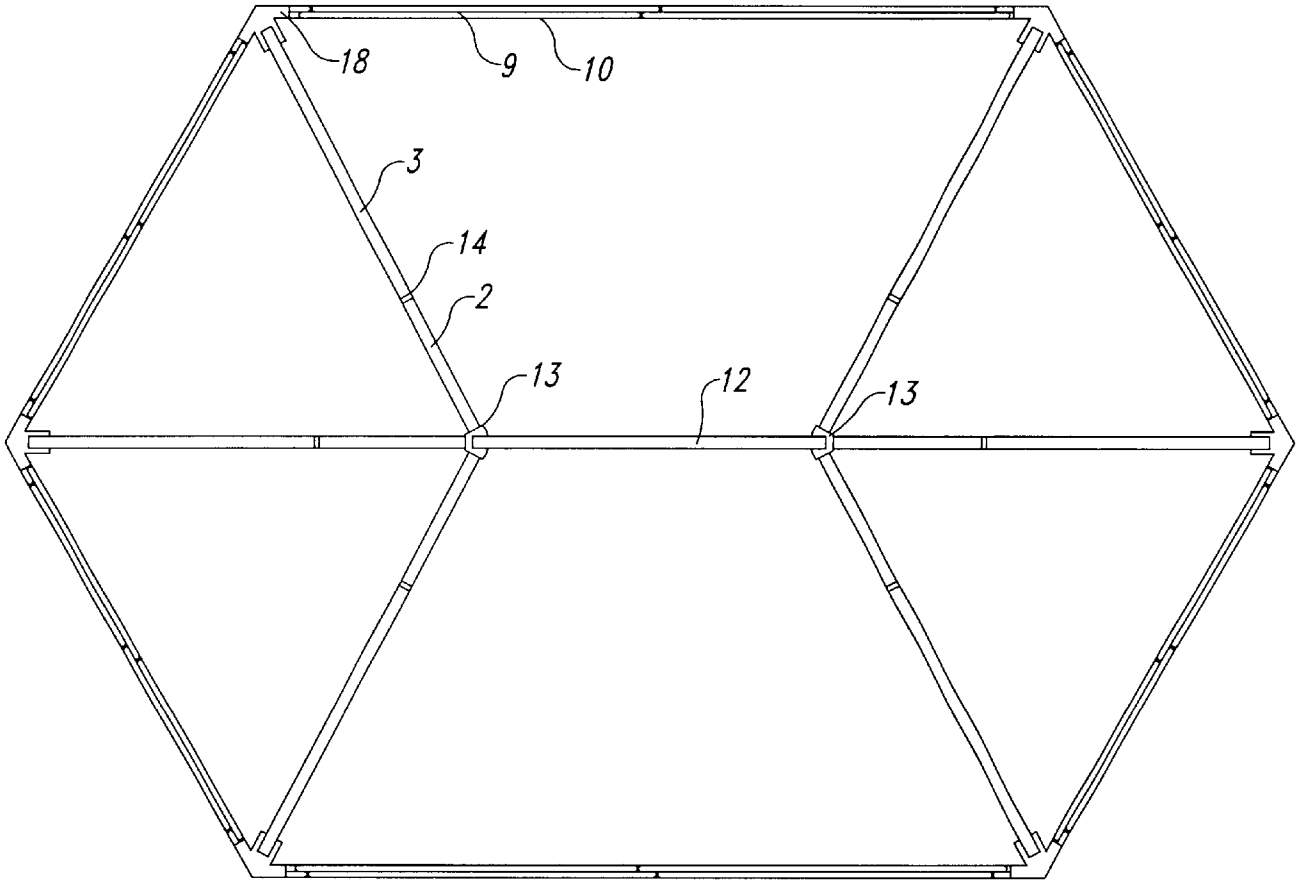
FIG. 3 is a plan view of a collapsible tent according to a third embodiment having six legs, six hips and a ridge.

A collapsible tent according to a third embodiment as shown in FIG. 3 is in the form of a long type hexagon and has six legs, six hips and a ridge. According to the present invention, a collapsible tent can be constructed to be in the form of a long type octagon, a nonagon, etc.

Figure 4:
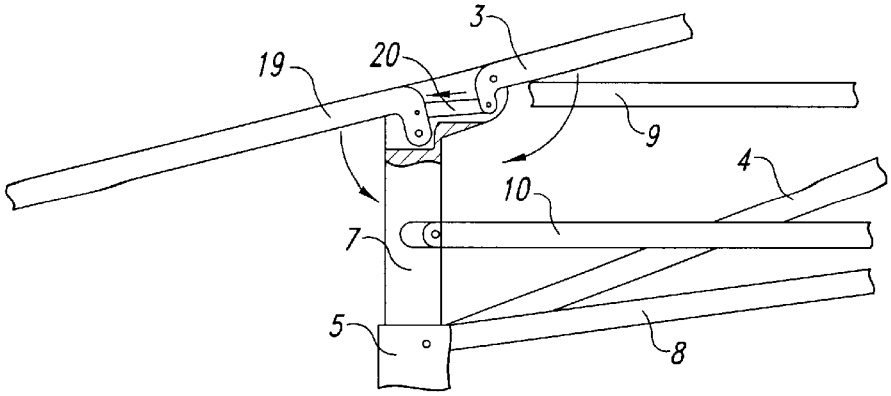
FIG. 4 is a partial view of an eaves portion of a collapsible tent according to the invention.

A collapsible tent according to the present invention can be provided with eaves to enlarge the area of the collapsible tent against the elements and to beautify the appearance of the collapsible tent. FIG. 4 illustrates an eaves means comprising an eaves bar 19 pivotally connected to the top of leg 7, and a link 20 pivotally connected at one end to eaves bar 19 and at the other end to the lower end of lower roof support bar 3. Leg 7, eaves link 19, link 20 and lower roof support bar 3 constitute a four bar linkage. The eaves means can be provided in any tent according to the present invention.

Figure 5:
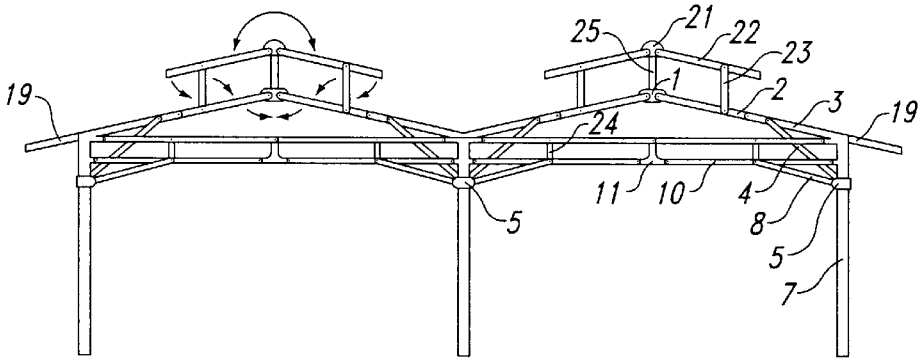
FIG. 5 is a front elevation of a collapsible rectangular duplex tent according to a forth embodiment formed from two tents each having a double roof.

Referring now to FIG. 5, there is shown a collapsible duplex tent according to a forth embodiment formed from two conjoined tents each having a double roof, which can enhance the heat insulation and ventilation of the tent. The double roof has a topmost connecting member 21, a central support bar 25 fixedly connected at one end to topmost connecting member 21 and at the other end to top connecting member 1, four uppermost roof support bars 22 which each are pivotally connected at one end to topmost connecting member 21, and four support bars 4 which each are pivotally connected at one end to uppermost roof support bar 22 and at the other end to upper roof support bar 2.

The collapsible tent in the form of a rectangle as shown in FIG. 5 has six legs 7, seven parallel bar assemblies which each are formed by upper parallel bars 9, lower parallel bars 10 and a T shaped connecting member 11, and interconnect adjacent ones of legs 7, six sliders 6 each connected to leg 7 for sliding contact therewith, fourteen stay bars 8 which each are pivotally connected at one end to its respective slider 6 and at the other end to its respective lower parallel bar 10, eight stay bars 4 which each are pivotally connected at one end to its respective slider 6 and at the other end to its respective lower roof support bar 3, and six stop means (not shown in FIG. 6) for maintaining sliders 5 in positions to maintain the tent in an erected position. The parallel bar assembly between two central legs 7 may be omitted.

According to the present invention, a collapsible tent may be formed by conjoining three or more tents as shown in FIGS. 1–4. These tents may be arranged along a line, in the form of an L, etc. That is to say, the collapsible tent may be constructed to be triplex, quadruplex or any other multiplex.

In case upper and lower parallel bars 9, 10 are longer, a reinforcing bar 24 may be provided to be pivotally connected at one end to its respective upper parallel bar 9 and at the other to its respective lower parallel bar 10, as shown in FIG. 5.

The collapsible tent in FIG. 5 may have a roof as shown in FIGS. 1, 2.

Figure 6:
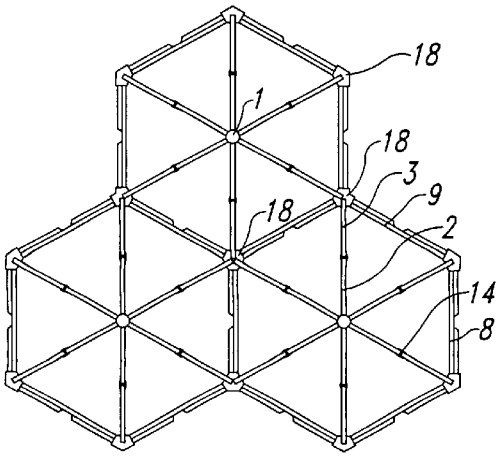
FIG. 6 is a plan view of a collapsible triplex tent according to a fifth embodiment formed from three hexagonal tents.

A collapsible triplex tent according to a fifth embodiment formed from three hexagonal tents according to the present invention is shown in FIG. 6. Two or more hexagonal tents according to the invention can be conjoined to form a new tent according to the invention.

Figure 7:
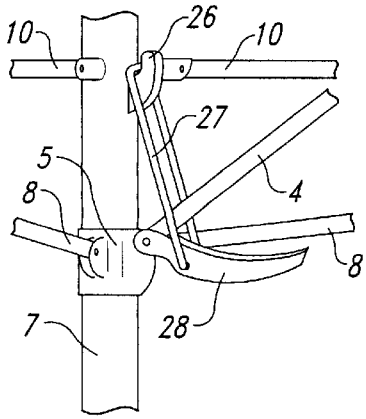
FIG. 7 is a view showing the structure of a stop means in the form of a case buckle.

FIG. 7 shows the structure of a stop means in the form of a case buckle. The stop means comprises a hook 26 fixedly attached on leg 7, a handle 28 pivotally connected at one end to slider 5, and a retaining ring 27 pivotally connected at one end to handle 28. The stop means used in the tents according to the invention may be a button latch or any other means capable of maintaining slider 5 in position.

Legs and bars as described above may be solid or hollow, and may be made of metal or plastic.

Any tent according to the present invention, as shown above, can be expanded or collapsed by separating or closing legs with all the movable members of the tent moving interlockingly and synchronously to expand or collapse the tent.

Any tent according to the present invention has a simple, compact and firm structure with few structural members.

The tents according to the present invention can be produced as serialization products for various situation applications.

I claim:

1. A collapsible tent comprising:

at least one top connecting means at the top of the tent;

a plurality of upright legs;

a slider slideably received on each upright leg;

upper roof support bars which are pivotally connected at the upper ends thereof to said top connecting means;

lower roof support bars, each connected at one end to its respective upper roof support bar and at the other end to a top of its respective upright leg;

first stay bars, each connected at one end to its respective lower roof support bar and at the other end to said slider;

a parallel bar assembly interconnecting adjacent ones of said upright legs, each parallel bar assembly having:

a T shaped connecting member, upper parallel bars, each of which is pivotally connected at one end to the vertical leg of said T shaped connecting member and at the other end to the upper end of its respective leg, and lower parallel bars, each of which is pivotally connected at one end to its respective flange of said T shaped connecting member and at the other end to the upper end of its respective leg;

second stay bars for supporting said parallel bar assembly, each second stay bar pivotally connected at one end to its respective lower parallel bar and at the other end to said slider; and stop means for maintaining said slider in position to maintain the tent in an erected position.

2. A collapsible tent as defined in claim 1 wherein said at least one top connecting means is a top connecting member at the apex of the roof of the tent.

3. A collapsible tent as defined in claim 1 wherein said at least one top connecting means comprises two top connecting members and two bars which are pivotally connected to each other and each of which is pivotally connected to its respective top connecting member.

4. A collapsible tent as defined in claim 1 wherein adjacent ones of said upright legs are interconnected by a conjoined parallel bar assembly formed by a plurality of pairs of said parallel bar assemblies connected together by means of said T shaped connecting member.

5. A collapsible tent as defined in claim 1 wherein said upright legs are telescopic.

6. A collapsible tent as defined in claim 1 wherein it has an eaves means comprising an eaves bar pivotally connected to the top of said leg, and a link pivotally connected at one end to said eaves bar and at the other end to the lower end of said lower roof support bar.

7. A collapsible tent as defined in claim 1 wherein it has a double roof comprising:

a topmost connecting member;

a central support bar fixedly connected at one end to said topmost connecting member and at the other end to said top connecting member;

uppermost roof support bars which each are pivotally connected at one end to said topmost connecting member; and support bars which each are pivotally connected at one end to said uppermost roof support bar and at the other end to its respective upper roof support bar.

8. A plurality of collapsible tents, each of which is defined in claim 1, the plurality of collapsible tents being conjoined to form a multiplex tent.

9. A collapsible tent frame comprising:

a plurality of upright legs;

a plurality of roof support members, each connected to at least one of the upright legs and to at least one top connecting member; and at least one parallel bar assembly interconnecting adjacent ones of the legs, each parallel bar assembly having:

a connecting member disposed between the adjacent ones of the legs;

at least two upper parallel bars, each connected to the connecting member at one end adjacent an end of the other upper parallel bar, and at another end to one of the legs; and at least two lower parallel bars, each connected to the connecting member at one end adjacent an end of the other lower parallel bar, and at another end to one of the legs.

10. The collapsible tent frame of claim 9 wherein there is an upper distance between the adjacent ends of the upper parallel bars and a lower distance between the adjacent ends of the lower parallel bars and one of the upper and lower distance is greater than the other.

11. The collapsible tent frame of claim 10 further comprising:

at least one stay bar connected to at least one of the roof support members and to a slider assembly that is slideably connected to at least one of the upright legs.

12. The collapsible tent frame of claim 10 wherein each roof support member comprises a lower roof support bar and an upper roof support bar, each lower roof support bar being pivotally connected to the upper roof support bar, with each lower roof support bar also being pivotally connected to an upright leg.

13. The collapsible tent frame of claim 12 wherein the upper roof support bars are connected to a top connecting member at the apex of the tent frame.

14. The collapsible tent frame of claim 12 further comprising two top connecting members and two bars, with each of the two bars pivotally connected to one of the top connecting members at an end, and pivotally connected to each other at another end, with each of the top connecting members also connected to at least one of the upper roof support bars.

15. The collapsible tent frame of claim 10 wherein said upright legs are telescopic.

16. The collapsible tent frame of claim 10 further comprising at least one eaves member pivotally connected to at least one of the upright legs.

17. The collapsible tent frame of claim 16 further comprising a linking member disposed between the eaves member and the roof support member, the linking member being pivotally connected to both the eaves member and the roof support member.

18. The collapsible tent frame of claim 10 further comprising a double roof.

19. A plurality of collapsible tent frames, each of which is defined by claim 10, with each collapsible tent frame being conjoined with at least one of the other of the plurality of tent frames to form a multiplex tent.

* * * * *

UNITED STATES PATENT AND TRADEMARK OFFICE

CERTIFICATE OF CORRECTION

PATENT NO. : 6,283,136 B1
DATED : September 4, 2001
INVENTOR(S) : Fengchun Chen

It is certified that error appears in the above-identified patent and that said Letters Patent is hereby corrected as shown below:

Column 4,
Line 65, "A collapsible tent as defined in claim 1" should be corrected to read -- The collapsible tent as defined in claim 1 --;

Column 5,
Line 1, "A collapsible tent as defined in claim 1" should be corrected to read -- The collapsible tent as defined in claim 1 --;
Line 6, "A collapsible tent as defined in claim 1" should be corrected to read -- The collapsible tent as defined in claim 1 --;
Line 11, "A collapsible tent as defined in claim 1" should be corrected to read -- The collapsible tent as defined in claim 1 --;
Line 13, "A collapsible tent as defined in claim 1" should be corrected to read -- The collapsible tent as defined in claim 1 --;
Line 18, "A collapsible tent as defined in claim 1" should be corrected to read -- The collapsible tent as defined in claim 1 --;

Column 6,
Lines 40 and 41, "The collapsible tent frame of claim 10 further comprising a double roof." should be corrected to read -- The collapsible tent frame of claim 10 wherein it has a double roof comprising:
a top connecting member; and
a topmost connecting member disposed above the top connecting member. --.

Signed and Sealed this

Twenty-eighth Day of May, 2002

*Attest:*

*Attesting Officer*

JAMES E. ROGAN
*Director of the United States Patent and Trademark Office*